US005943802A

United States Patent [19]

Tijanic

[11] Patent Number: 5,943,802

[45] Date of Patent: Aug. 31, 1999

[54] REFLECTIVE DISPLAY WITH FRONT LIGHTING

[75] Inventor: Veso S. Tijanic, Ontario, Canada

[73] Assignee: Mark IV Industries Limited, Mississauga, Canada

[21] Appl. No.: 08/833,469

[22] Filed: Apr. 7, 1997

[51] Int. Cl.[6] ..... G09F 11/00

[52] U.S. Cl. ..... 40/591; 40/559; 40/450

[58] Field of Search ..... 40/450, 451, 452, 40/591, 559, 560; 362/26, 27, 31; 340/815.45, 815.53, 815.54, 815.62

[56] References Cited

U.S. PATENT DOCUMENTS 3,399,402 8/1968 Brown ..... 40/451
4,021,945 5/1977 Sussman ..... 40/452
5,022,171 6/1991 Norfolk et al. ..... 40/452
5,276,591 1/1994 Hegarty ..... 362/32
5,390,436 2/1995 Ashall ..... 40/546

*Primary Examiner*—Kenneth J. Dorner
*Assistant Examiner*—Fredrick Conley
*Attorney, Agent, or Firm*—Dowell & Dowell

[57] ABSTRACT

Each element in an array of display elements has first and second limiting positions and in respective limiting positions selectively displays a bright and a dark surface in a viewing direction. A transparent sheet is intermediate the array and the viewer. Conductors on said sheet direct light toward said array.

13 Claims, 3 Drawing Sheets

REFLECTIVE DISPLAY WITH FRONT LIGHTING

This invention relates to means for the enhancement of the appearance of signs, particularly writable display signs.

Writable display signs typically have an array of display elements which are controllable (usually electromagnetically) to display in an ON position, a bright surface for viewing by a viewer in a viewing direction and in an OFF position, a dark surface for viewing by a viewer in the viewing direction. The array may be activated so that the elements provide information or a different form of display.

Usually the elements are arranged as pixels in an array and usually, in such array, the pixels are arranged in rows and columns.

The bright surface displayed in the ON position is more or less clearly visible dependent upon the ambient light. In many applications therefore it is desirable to illuminate the array so the bright surfaces appear more brightly and contrast more with the dark surfaces.

Prior ways have been found to illuminate such elements but these have tended to increase the depth required by the array or increased the expense of making or operating such sign. In such an application as a vehicle destination sign the increase in depth tends to increase the distance of the array from the windshield reducing the angle over which the array may be read.

There is herein provided a method of and means for illuminating the array of a changeable display sign comprising providing a transparent sheet in front of said array, so that the viewing direction for the sign passes through the transparent sheet.

The transparent sheet is typically the transparent front wall of a casing for the array. It could also be the windshield of a bus or other vehicle, Using a vehicle windshield or vehicle window as the front transparent sheet would have some advantages since it would provide a wide angle for viewers located outside the vehicle. However using the vehicle windshield or window is usually inconvenient since its manufacture is primarily associated with the vehicle, rather than with the sign.

In accord with the invention, the illumination for the array will be lights mounted on the transparent sheet and directed towards the array, that is away from the viewer. Thus the lights illuminate the bright surfaces of those elements which are in ON position for display in the viewing direction. This is a simple and easy way of increasing the contrast and hence the clarity of the sign without unduly increasing its depth.

Although the terminology used herein generally speaks of a sign viewable from the front, signs may equally be installed to be viewable from the back or sides or may be located elsewhere than on a vehicle.

In a preferred form of the above invention, the lights are light emitting diodes or LED's.

The display elements may be of many different forms. They will quite commonly be rotatably mounted disks which are bright on one side and dark on the other, so that the bright and dark side of an element are displayed to the viewing direction in the ON and OFF positions, respectively, of the disks.

The transparent sheet may, if desired, be made flexible to conform to a curved space, such as inside a curved bus windshield.

When the illumination is by LEDS these are preferably connected across gaps in a circuit applied to the transparent sheet to shine in a direction away from the viewer and toward the display elements. The conductor is usually a conducting ink which is usually opaque but relatively insignificant and innoticeable to the viewer.

In drawings which illustrate a preferred embodiment of the invention:

In the description, two definitions should be noted.

'LED' here, refers to the LED chip itself, here shown at 10 and its associated wire 11 as embedded in the plastic 12 forming the lens. Other usages tend to consider the 'LED' as the chip and lens combined.

Most PWB's are opaque and hence would be useless for forming the front of a sign casing of this invention. Thus the invention is only concerned with PWB's or equivalents which are transparent or concerned with other transparent sheets for carrying the LEDS and their circuits.

Figure 1:
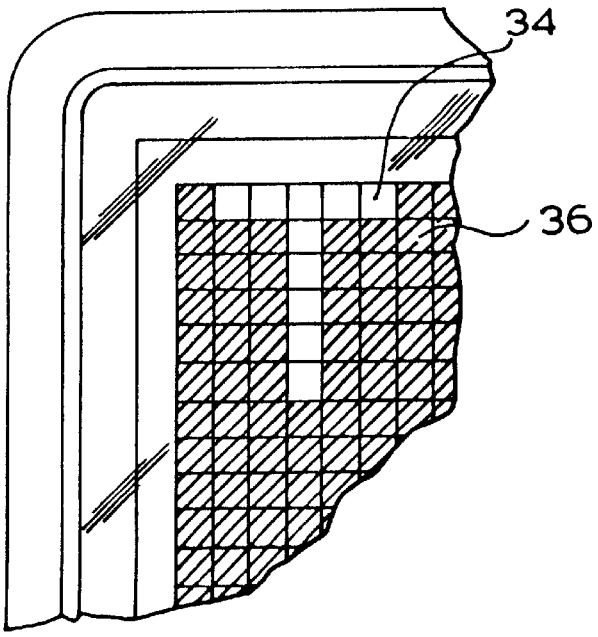
FIG. 1 is a schematic broken view showing a partial array of display elements with bright and dark sides chosen to form the letter "T" in the bright surfaces of elements against a dark background.

In FIG. 1 the front of a bus 14' mounts a bus destination sign casing 16 containing a flip disk sign array 14.

Figure 2:
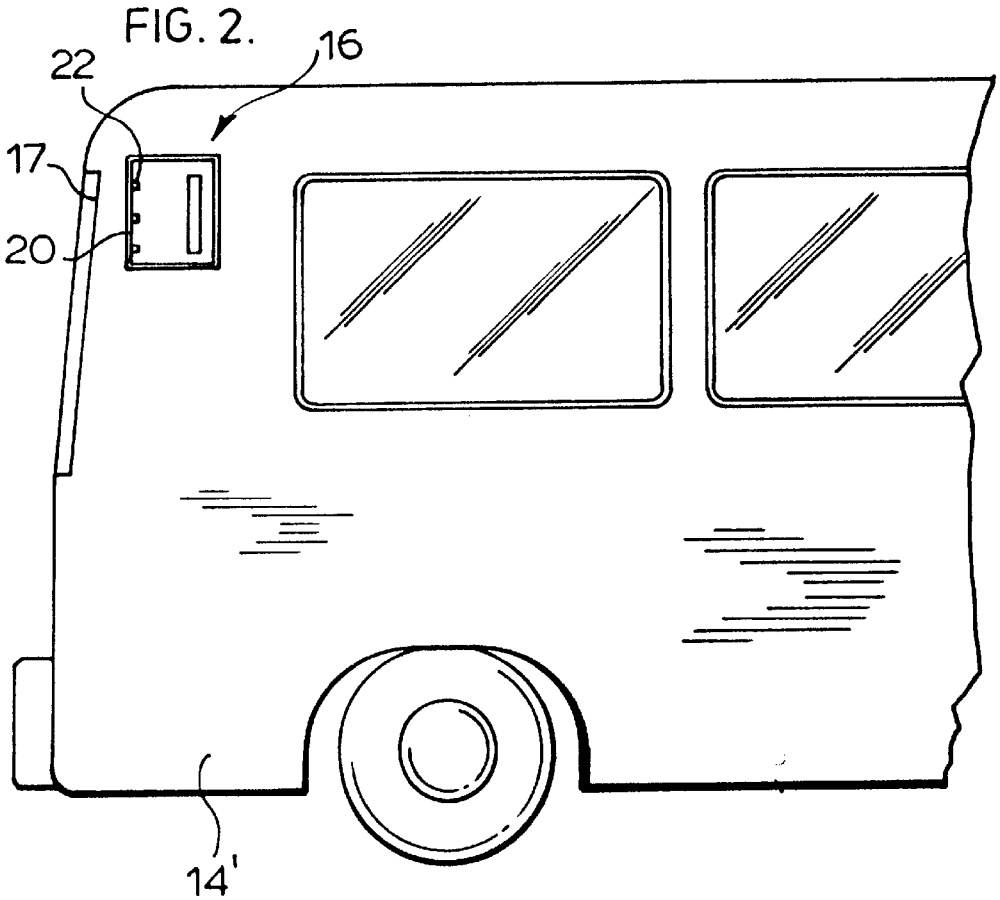
FIG. 2 is a side view of the front of a bus with the sign casing and windshield shown in section.

As shown in FIG. 2 the flip disk array is seen through the vehicle windshield 17 and the casing front wall 20 which is a transparent PWB usually of glass or plastic.

Figure 6:
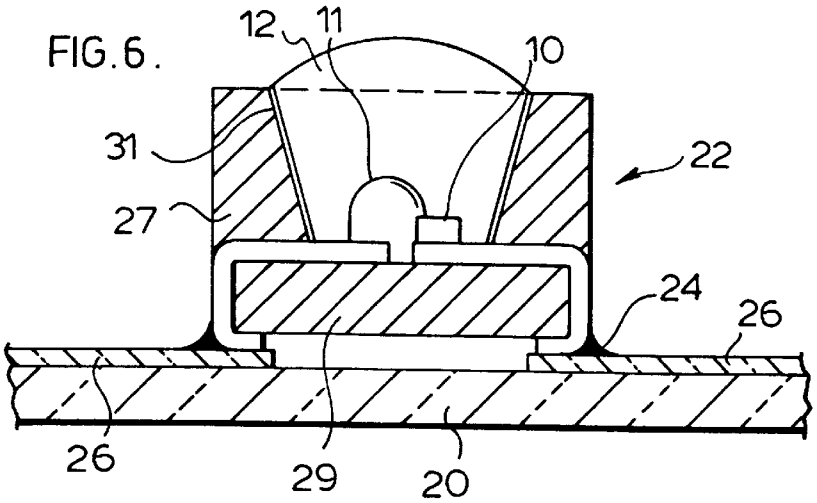
FIG. 6 is a perspective view of a LED mounted on a transparent printed wiring board ('PWB') which acts transparent sheet and as the front of the casing.
Figure 7:
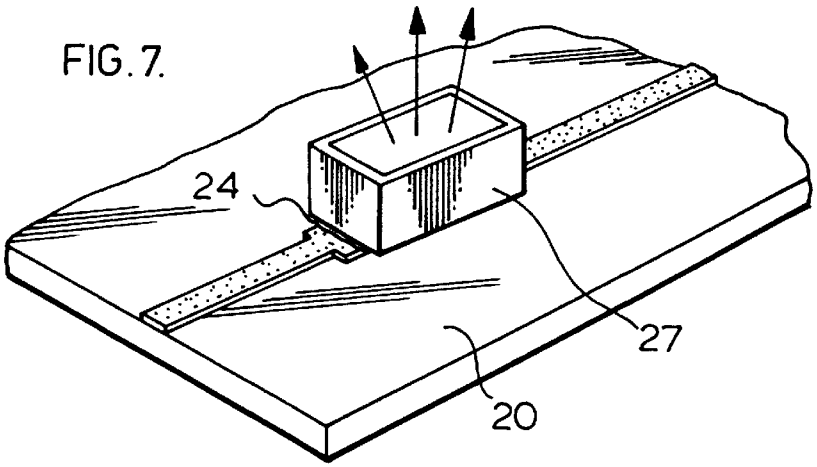
FIG. 7 is a section through the LED and lens system.
Figure 5:
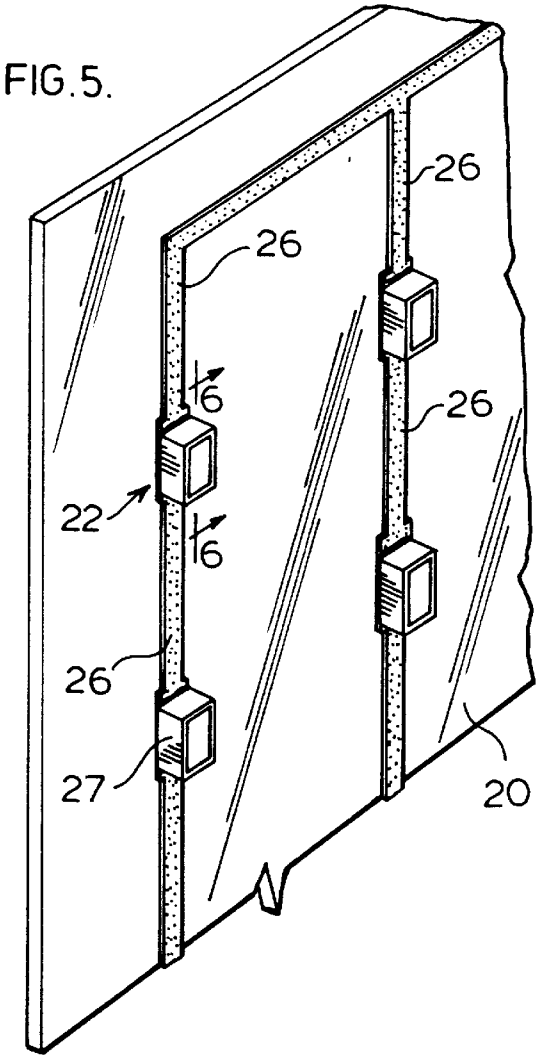
FIG. 5 shows the transparent casing front having trace conductors and LEDS.

In FIG. 2 a section of the bus, illustrates the fact that the LED housings 22 are mounted on the inside of the PWB, 20 with conducting adhesive 24 (FIG. 7) to shine backwardly from the PWB 20 onto the array. The LED chip 10 as shown in FIG. 6 conducts between conductors 26 which are traces printed on or attached to the inside of the PWB. Thus the conducting traces 26 (FIG. 5) carry current from a V+ source through a number of LEDS 10 arranged in series circuits which series circuits are arranged in parallel. This is believed more efficient for proper energizing of the LEDS than a plurality of LED's arranged in parallel circuits which parallel circuits are arranged in series.

The conducting traces are preferably formed from silver ink but may be formed of another conducting ink which is both conducting and opaque. Silver ink or silver may also be used in rendering conducting the conducting adhesive 24. However, other conducting components in the adhesive may be used.

The casing forming the opaque enclosure for the LED and cell is preferably formed of white plastic apertured to allow conducting connection between a conductor 26 and the anode or cathode of LED chip 10. The inwardly sloping walls of the casing reflecting (here covered with reflecting tape 31 to assist in reflecting rays from the LED chip toward the array. The casing side walls 27 and bottom walls 29 are preferably of opaque white plastic. With its side and rear walls it prevents escape of LED rays in unwanted directions and prevents direct viewing of LED rays by a viewer. The inside of the casing walls is, as above described, preferably reflective of the LED rays and tends to direct them toward the display elements as desired.

The LEDS and lenses therefore illuminate surfaces of the disks facing in the viewing direction and cause the bright or ON areas 34 to contrast well with dark areas 36 to the viewer looking in viewing direction V.

The LED casing includes opaque side walls 27 and bottom walls 29 which act as a shroud to prevent the viewer looking in direction V from seeing direct light from the LED only seeing reflected light from the disk bright faces. The opaque walls 27 and 29 are inwardly preferably covered with tape 33 having a reflecting surface to reflect light from the chip in the general direction of the disks.

Figure 3:
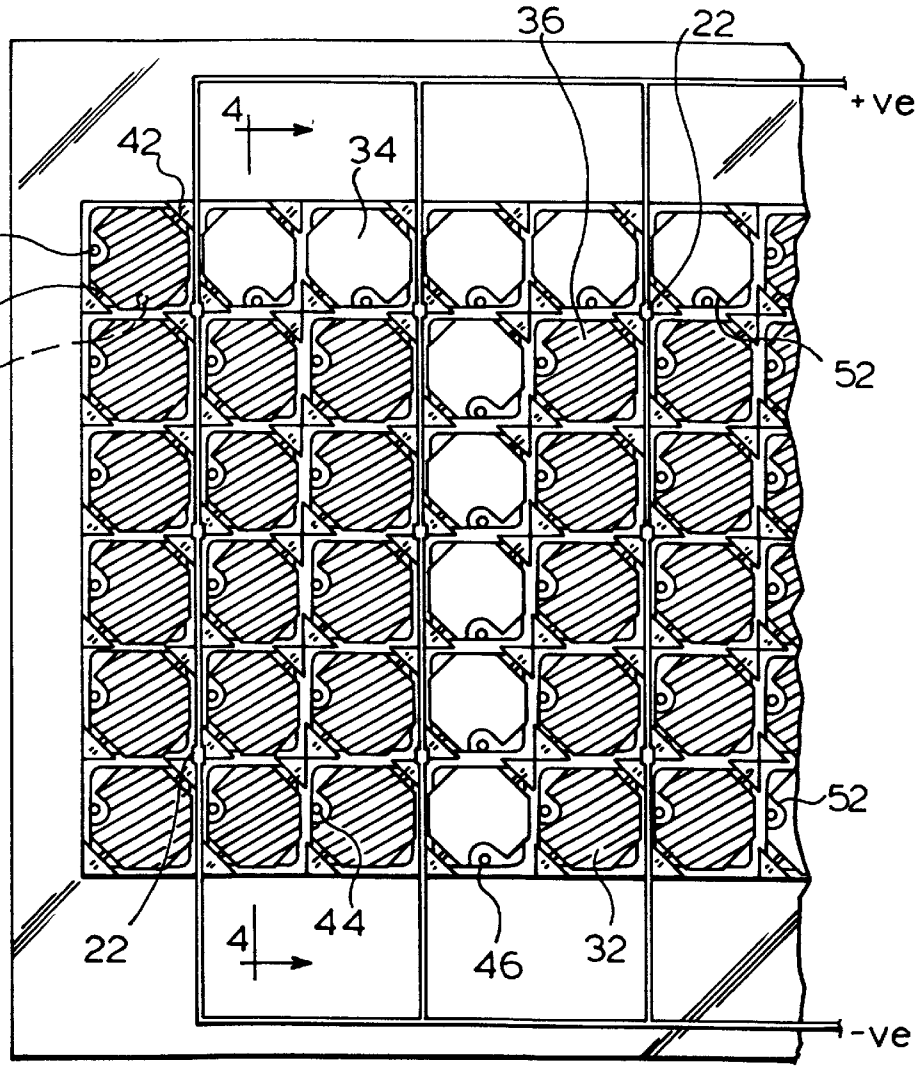
FIG. 3 is a view of a portion of the sign as viewed from in front of the bus.

As demonstrated by FIG. 3, the LED casings 22 are relatively small relative to a display element and with the relatively small substantially opaque traces 26 do not detract from the appearance of the display just as embedded wires for heating a rear automobile windshield are substantially invisible for most purposes.

In most if not all prior art light augmented flip disks there is a light (usually LED or optic fibre) for each display element, and such individual light must be shuttered or switched when the moveable disk was in OFF position.

However with the invention, the LED is never directed toward the viewer. Hence shuttering and switching is not required. Thus the LEDS may be on all the time and a single LED may illuminate several elements.

The LED's therefore must provide sufficient light to collectively illuminate all the disk bright sides visible to the viewer.

Although FIG. 3 shows an LED at the centre of each 2×2 square of disks, there is no requirement that the centre to centre spacing of the LED casings in a row or column correspond to in integral multiples of the pixel spacing. So that LED casings need not align with intersections between the pixels.

Although rotatable disks 32 are shown, the display will be equally useful if it uses moveable but not necessarily rotatable elements which also alternate between light and dark areas in locations on the array.

Moreover the arrangement of pixels in the array need not be in rows and columns but may be in other arrangements.

Figure 4:
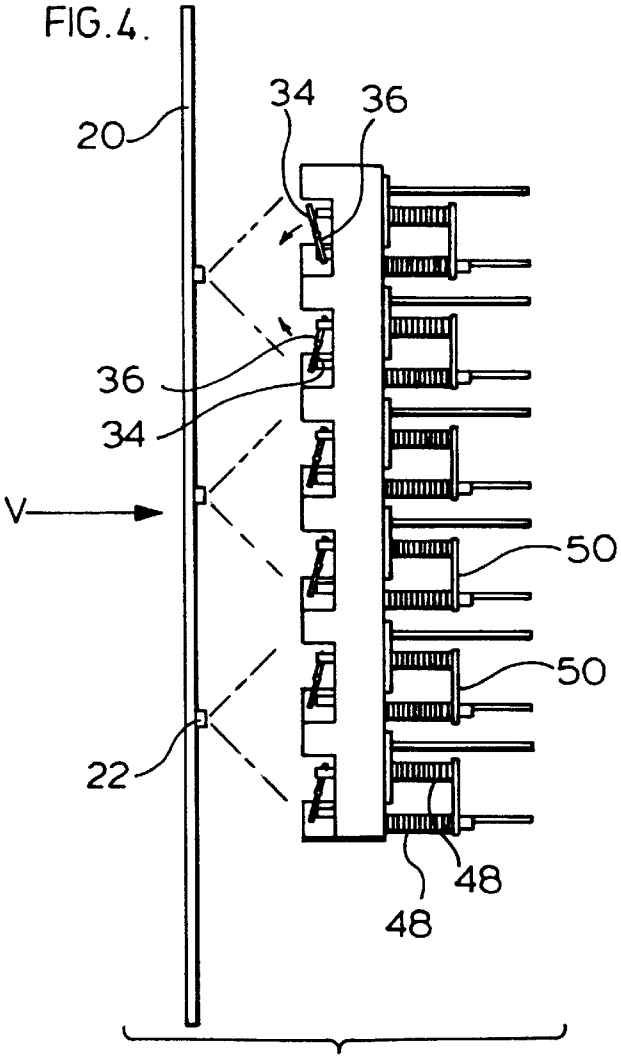
FIG. 4 is a side view along the lines 4—4 of FIG. 3 and showing the viewing direction V which is that of a viewer of the device some distance to the left of the array, as shown in FIG. 4.

The disk shown in FIGS. 3 and 4 is a preferred version for use with the invention chosen from a number of disks, and arrays which may be used with the LEDS and transparent sheets of the invention. The electromagnetic operation is well known to those skilled in the art and only briefly described here.

With the disk of FIGS. 3 and 4, the disk is approximately octagonal in a generally square mount and rotates just less than 180 (between the illustrated position of the top elements of FIG. 4) on its diagonal axis as defined by pivot pins 42 to display, facing the viewing direction V, either a bright side 34 or a dark side 36. The disk contains a magnet, not shown having an axis extending between the pole pieces 44 and 46 of mutually opposite polarity and actuable by the switching of pole pieces to move between positions displaying the bright or the dark surface in the viewing direction. The coils 48 on the pole pieces 44 and 46 are joined by bridging member 50 and are actuated by conductors (not shown) on the rods 54 and 56 to switch the pole piece polarities. The pole pieces 44 and 46 also, in this version respectively act as stops for the disk which is each limiting position is stopped by a pole piece end while the cut out 52 in the disk surrounds the other pole piece, the side with the cut-out ready to rotate toward the other limiting position in a direction away from the viewer of FIG. 3 and to the right in FIG. 4.

Tilt of the array and/or its casing can be arranged in any preferred manner can be arranged to provide selected viewing directions such as a downward or leftward inclination for the benefit of viewers on the sidewall.

A disk with a vertical rather than a diagonal axis is shown in U.S. Pat. No. 4,577,427 Brown dated Mar. 25, 1986 whose backups are incorporate herein by reference.

Other disks suitable for use with the backward illumination of the invention:

U.S. Pat. No. 4,156,872 Helwig May 29, 1979

U.S. Pat. No. 4,069,480 Helwig Jan. 17, 1978

Alternatives to a disk are movable bars of the U.S. Pat. No. 4,744,163 Browne, May 17, 1988 and U.S. Pat. No. 4,566,210 Winrow, dated Jan. 28, 1986. These alternatives may also usefully be illuminated by rearward shining LEDS arranged on a circuit in accord with the invention.

I claim:

1. In combination:

an array of display elements; defining a viewing direction, forwardly of said array, each such element having ON and OFF positions and selectively displaying a bright surface in the viewing direction in one of the ON and OFF positions and a dark surface in the viewing direction in the other of the ON and OFF positions, a substantially transparent sheet for location in said viewing direction between a viewing direction between a viewer and said array, at least one light source located on said sheet arranged to direct light toward said array, conductors for energizing said at least one light source mounted on said sheet.

2. In combination as claimed in claim 1 wherein said at least one light source is a light emitting diode ('LED').

3. In combination as claimed in claim 1 wherein said display elements are disks rotatable on a transverse axis and arranged to display a bright or a dark side in the viewing direction.

4. In combination as claimed in claim 1 wherein said array is contained in a housing and said transparent sheet forms a front wall of said housing.

5. In combination as claimed in claim 1 wherein said transparent sheet is flexible.

6. In combination as claimed in claim 2 wherein said transparent sheet is flexible.

7. In combination as claimed in claim 2 wherein said at least one LED will be between said sheet and said array.

8. In combination as claimed in claim 2 wherein said at least one LED is connected across a gap in a substantially transparent conductor made of a conducting matrix.

9. In combination as claimed in claim 8 wherein said conductor is a conducting ink.

10. In combination as claimed in claim 1 wherein said conductor is painted on said sheet.

11. In combination as claimed in claim 2 wherein said LED is contained in a casing which allows light from said LED to shine on at least one of said array elements.

12. In combination as claimed in claim 11 wherein said LED is combined with a transparent lens and wherein said casing comprises an opaque wall on said lens blocking light from said LED from directly reaching a viewer looking in said viewing direction, but allows such light to illuminate said display element.

13. In combination as claimed in claim 12 wherein said wall has a reflectant inside surface.

* * * * *

UNITED STATES PATENT AND TRADEMARK OFFICE

CERTIFICATE OF CORRECTION

PATENT NO. : 5,943,802

DATED : August 31, 1999

INVENTOR(S) : Veso S. Tijanic

It is certified that error appears in the above-identified patent and that said Letters Patent is hereby corrected as shown below:

In the claims, at column 4, lines 18-32, claim 1 should read:

1. In combination:

an array of display elements; defining a viewing direction, forwardly of said array, each such element having ON and OFF positions and selectively displaying a bright surface in the viewing direction in one of the ON and OFF positions and a dark surface in the viewing direction in the other of the ON and OFF positions, a substantially transparent sheet for location in said viewing direction between a viewer and said array, at least one light source located on said sheet arranged to direct light toward said array, conductors for energizing said at least one light source mounted on said sheet.

Signed and Sealed this

Eighteenth Day of January, 2000

*Attest:*

*Attesting Officer*

Q. TODD DICKINSON

*Commissioner of Patents and Trademarks*